US009633601B2

(12) United States Patent
Cheon et al.

(10) Patent No.: US 9,633,601 B2
(45) Date of Patent: Apr. 25, 2017

(54) DISPLAY DEVICE AND METHOD OF DRIVING THE DISPLAY DEVICE

(71) Applicant: Samsung Display Co., Ltd., Yongin, Gyeonggi-Do (KR)

(72) Inventors: Man-Bok Cheon, Yongin-si (KR); Jin-Ho Lee, Cheonan-si (KR); Seung-Ho Park, Suwon-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 170 days.

(21) Appl. No.: 14/699,993

(22) Filed: Apr. 29, 2015

(65) Prior Publication Data

US 2016/0155382 A1 Jun. 2, 2016

(30) Foreign Application Priority Data

Nov. 27, 2014 (KR) ..... 10-2014-0167522

(51) Int. Cl.
*G09G 3/32* (2016.01)
*G09G 3/3233* (2016.01)
(Continued)

(52) U.S. Cl.
CPC ..... *G09G 3/3233* (2013.01); *G09G 3/3225* (2013.01); *G09G 3/3258* (2013.01);
(Continued)

(58) Field of Classification Search
CPC ..... G09G 3/3233; G09G 3/3258; G09G 2320/0233; G09G 2320/0626; G09G 2320/0666
See application file for complete search history.

(56) References Cited

U.S. PATENT DOCUMENTS 5,451,979 A * 9/1995 Levac ..... G09G 3/32 345/212
6,147,664 A * 11/2000 Hansen ..... G09G 3/22 315/169.1
(Continued)

FOREIGN PATENT DOCUMENTS

KR 10-2010-0021094 A 2/2010
KR 10-2013-0055256 A 5/2013
KR 10-2014-0048691 A 4/2014

*Primary Examiner* — Gene W Lee
(74) *Attorney, Agent, or Firm* — Knobbe Martens Olson & Bear LLP

(57) ABSTRACT

A display device and a method of driving the same are disclosed. In one aspect, the display device includes a gamma generator configured to generate emission duty data having an emission duty period based on input image data, a panel load calculator configured to calculate a load of the display panel, and a target driving voltage determiner configured to determine a target driving voltage. The display device also includes an emission duty controller configured to adjust the emission duty period and determine a target global current, driver configured to drive the display panel, and a driving voltage generator configured to supply the driving voltage to the display panel, measure driving currents flowing into the display panel, and adjust the driving voltage to include the target driving voltage based on the difference between the sum of the measured driving currents and the target global current.

20 Claims, 5 Drawing Sheets

(51) Int. Cl.
*G09G 3/3258* (2016.01)
*G09G 3/3225* (2016.01)

(52) U.S. Cl.
CPC ..... *G09G 2320/0233* (2013.01); *G09G 2320/0276* (2013.01); *G09G 2320/046* (2013.01); *G09G 2320/0626* (2013.01); *G09G 2320/0666* (2013.01); *G09G 2320/0673* (2013.01); *G09G 2330/021* (2013.01); *G09G 2330/025* (2013.01); *G09G 2330/045* (2013.01); *G09G 2360/16* (2013.01)

(56) References Cited

U.S. PATENT DOCUMENTS 6,291,942 B1 * 9/2001 Odagiri ..... G09G 3/12 315/169.3
6,762,742 B2 * 7/2004 Moon ..... G09G 3/3406 345/102
7,242,153 B2 * 7/2007 Yu ..... G09G 3/3406 315/209 R
8,077,137 B2 * 12/2011 Lee ..... G09G 3/3413 345/102
8,471,876 B2 * 6/2013 Byun ..... G09G 3/3225 345/690
8,531,446 B2 * 9/2013 Woo ..... H02M 3/156 323/282
8,537,081 B2 * 9/2013 Awakura ..... G09G 3/3208 345/208
8,624,828 B2 * 1/2014 Uchimoto ..... H05B 33/0815 345/102
9,093,028 B2 * 7/2015 Chaji ..... G09G 3/3233
9,171,504 B2 * 10/2015 Azizi ..... G09G 3/006
9,232,579 B2 * 1/2016 Sasaki ..... H05B 33/0815
9,262,965 B2 * 2/2016 Chaji ..... G09G 3/3233
2005/0068270 A1 * 3/2005 Awakura ..... G09G 3/3208 345/76
2006/0244697 A1 * 11/2006 Lee ..... G09G 3/3233 345/77
2007/0080905 A1 * 4/2007 Takahara ..... G09G 3/3233 345/76
2007/0182672 A1 * 8/2007 Hoppenbrouwers ..... G09G 3/3233 345/76
2008/0002103 A1 * 1/2008 Lee ..... G02F 1/133603 349/68
2008/0074382 A1 * 3/2008 Lee ..... G09G 3/3413 345/102
2009/0122003 A1 * 5/2009 Chen ..... G09G 3/3406 345/102
2010/0171774 A1 * 7/2010 Mizukoshi ..... G09G 3/3275 345/690
2010/0328365 A1 * 12/2010 Ikeda ..... G09G 3/3233 345/690
2011/0157141 A1 * 6/2011 Woo ..... H02M 3/156 345/212
2011/0193489 A1 * 8/2011 Moss ..... H05B 33/0818 315/210
2011/0267375 A1 * 11/2011 Yang ..... G09G 3/3406 345/690
2013/0257845 A1 * 10/2013 Chaji ..... G09G 3/3291 345/212
2014/0333603 A1 * 11/2014 Choi ..... G09G 3/3233 345/212
2014/0333680 A1 * 11/2014 Choi ..... G09G 3/3233 345/690
2014/0354698 A1 * 12/2014 Lee ..... G09G 3/3258 345/690
2015/0116300 A1 * 4/2015 Yamaki ..... G02F 1/1368 345/212
2015/0243218 A1 * 8/2015 Tseng ..... G09G 3/3258 345/212
2015/0294622 A1 * 10/2015 Chaji ..... G09G 3/3291 345/80
2016/0117970 A1 * 4/2016 Matsui ..... G09G 3/3406 345/690

* cited by examiner

DISPLAY DEVICE AND METHOD OF DRIVING THE DISPLAY DEVICE

CROSS-REFERENCE TO RELATED APPLICATION(S)

This application claims priority under 35 USC §119 to Korean Patent Application No. 10-2014-0167522, filed on Nov. 27, 2014 in the Korean Intellectual Property Office (KIPO), the contents of which are incorporated herein in its entirety by reference.

BACKGROUND

Field

The described technology generally relates to a display device and methods of driving the display device.

Description of the Related Technology

In one frame, a digitally driven display device can represent a grayscale level based on an emission duty that is the length of a light emission period. That is, the display device can adjust the length of the emission period (i.e., adjust the emission duty cycle) of pixels so that the display device can represent grayscale levels having a specific luminance. For example, the display device can represent a high grayscale level when the emission duty increases and a low grayscale level when the emission duty decreases. The display device (e.g., organic light-emitting diode (OLED) display) can emit light based on a driving current that flows into a pixel depending on a driving voltage. The luminance of emitted light can increase as the driving current increases. The driving current can increase as the driving voltage increases. Therefore, the luminance can increase as the driving voltage increases.

SUMMARY OF CERTAIN INVENTIVE ASPECTS

One inventive aspect is a display device supplying a compensated data signal to a degraded pixel.

Another aspect is a method of driving the display device.

Another aspect is a display device driven by a digital driving technique that includes a display panel including a plurality of pixels, a gamma generator configured to generate emission duty data having emission duty information based on input image data, a panel load calculator configured to calculate a load of the display panel based on the emission duty data, a target driving voltage determiner configured to selectively determine a target driving voltage according to a color of light emitted from the pixels to adjust a driving voltage to be the target driving voltage, an emission duty controller configured to adjust an emission duty of the emission duty data based on the calculated load and a magnitude of the target driving voltage and to determine a target global current, that is a targeted sum of currents to be flowed into the display panel, based on the calculated load, a display panel driver configured to drive the display panel based on the adjusted emission duty data, and a driving voltage generator configured to apply the driving voltage to the display panel, to measure driving currents flowing into the display panel, and to adjust the driving voltage to be the target driving voltage based on a difference between a sum of the measured driving currents and the target global current.

In example embodiments, the emission duty controller includes a power consumption controller configured to generate a first scale factor, that is applied to the calculated load to determine the target global current, based on the calculated load, to generate a second scale factor, that is an adjusted value of the first scale factor based on the magnitude of the target driving voltage, and to adjust the emission duty by applying the second scale factor to the emission duty data, and a global current determiner configured to determine the target global current based on the calculated load and the first scale factor.

In example embodiments, the second scale factor decreases when the target driving voltage increases and the second scale factor increases when the target driving voltage decreases.

In example embodiments, the power consumption controller generates the first scale factor corresponding to the calculated load referring to a predetermined Net Power Control (NPC) curve.

In example embodiments, the power consumption controller generates the decreased first scale factor according to an increase of the calculated load when the calculated load is greater than a predetermined critical load.

In example embodiments, the global current determiner applies the first scale factor to the calculated load to determine the target global current.

In example embodiments, the pixels include first to (n)th pixels, the emission duty data includes first to (n)th emission duty data, the driving currents include first to (n)th driving currents, where n is a positive integer, and a (k)th pixel includes a (k)th driving current generator configured to generate a (k)th driving current based on the driving voltage during a (k)th emission duty, that is an emission period of the (k)th pixel in one frame, corresponding to a (k)th emission duty data, and a (k)th light emitting diode configured to emit light based on the k-th driving current, where k is a positive integer less than or equal to n.

In example embodiments, a luminance of light emitted from the (k)th pixel is proportional to a product of the (k)th emission duty and the (k)th driving current.

In example embodiments, the gamma generator generates the emission duty data corresponding to grayscale levels included in the input image data based on a gamma curve.

In example embodiments, the panel load calculator calculates the load of the display panel by calculating a sum of the emission duty data.

In example embodiments, the target driving voltage determiner increases the target driving voltage as a degree of degradation of the pixels increases.

In example embodiments, the target driving voltage determiner increases the target driving voltage to increase a maximum luminance of light emitted from the pixels.

In example embodiments, the target driving voltage determiner decreases the target driving voltage to reduce power consumption of the pixels.

In example embodiments, the target driving voltage determiner determines the target driving voltage based on an image display mode.

In example embodiments, the pixels include red pixels emitting red light, green pixels emitting green light and blue pixels emitting blue light.

In example embodiments, the pixels include red pixels emitting red light, green pixels emitting green light, blue pixels emitting green light and white pixels emitting white light.

Another aspect is a method of driving a display device including a display panel that includes an operation of generating emission duty data having emission duty information based on input image data, an operation of calculating a load of the display panel based on the emission duty data, an operation of selectively determining a target driving voltage according to a color of light emitted from the pixels to adjust a driving voltage to be the target driving voltage, an operation of adjusting an emission duty of the emission duty data based on the calculated load and a magnitude of the target driving voltage, an operation of determining a target global current, that is a targeted sum of currents to be flowed into the display panel, based on the calculated load, an operation of driving the display panel based on the adjusted emission duty data, an operation of applying the driving voltage to the display panel, an operation of measuring driving currents flowing into the display panel, and an operation of adjusting the driving voltage to be the target driving voltage based on a difference between a sum of the measured driving currents and the target global current.

In example embodiments, the operation of adjusting the emission duty of the emission duty data includes an operation of generating a first scale factor, which is applied to the calculated load to determine the target global current, based on the calculated load, an operation of generating a second scale factor that is an adjusted value of the first scale factor based on the magnitude of the target driving voltage, and an operation of adjusting the emission duty by applying the second scale factor to the emission duty data.

In example embodiments, the operation of determining the target global current includes the operation of applying the first scale factor to the calculated load.

In example embodiments, the first scale factor corresponds to the calculated load referring to a predetermined Net Power Control (NPC) curve.

Another aspect is a display device, comprising a display panel including a plurality of pixels configured to emit light, wherein the display panel is configured to be digitally driven based at least in part on a driving voltage. The display device also comprises a gamma generator configured to generate emission duty data having an emission duty period based at least in part on input image data, a panel load calculator configured to calculate a load of the display panel based at least in part on the emission duty data and a target driving voltage determiner configured to selectively determine a target driving voltage based at least in part on a color of the emitted light. The display device further comprises an emission duty controller configured to i) adjust the emission duty period based at least in part on the calculated load and the magnitude of the target driving voltage and ii) determine a target global current based at least in part on the calculated load, wherein the target global current corresponds to a total target amount of current to be supplied to the display panel. The display device further comprises a display panel driver configured to drive the display panel based at least in part on the adjusted emission duty period and a driving voltage generator configured to i) supply the driving voltage to the display panel, ii) measure driving currents flowing into the display panel, and iii) adjust the driving voltage to include the target driving voltage based at least in part on the difference between the sum of the measured driving currents and the target global current.

In the above display device, the emission duty controller includes a power consumption controller configured to i) generate a first scale factor configured to be applied to the calculated load based at least in part on the calculated load, ii) adjust the first scale factor based at least in part on the magnitude of the target driving voltage so as to generate a second scale factor, and iii) apply the second scale factor to the emission duty data so as to adjust the emission duty period. In the above display device, the emission duty controller also includes a global current determiner configured to determine the target global current based at least in part on the calculated load and the first scale factor.

In the above display device, the power consumption controller is further configured to decrease the second scale factor when the target driving voltage increases and increase the second scale factor when the target driving voltage decreases.

In the above display device, the calculated load corresponds to a point on a predetermined net power control (NPC) curve.

In the above display device, the power consumption controller is further configured to decrease the first scale factor based at least in part on an increased amount of the calculated load when the calculated load is greater than a predetermined critical load.

In the above display device, the global current determiner is further configured to apply the first scale factor to the calculated load so as to determine the target global current.

In the above display device, the pixels include first to (n)th pixels, wherein the emission duty data includes first to (n)th emission duty data, wherein the driving currents include first to (n)th driving currents, where n is a positive integer, and wherein a (k)th pixel includes, where k is a positive integer less than or equal to n: a (k)th driving current generator configured to generate a (k)th driving current based at least in part on the driving voltage during a (k)th emission period of the (k)th pixel in one frame; and a (k)th light-emitting diode (LED) configured to emit light based at least in part on the (k)th driving current.

In the above display device, the luminance of the light emitted from the (k)th pixel is substantially proportional to the product of the (k)th emission duty period and the k-th driving current.

In the above display device, the gamma generator is further configured to generate the emission duty data corresponding to grayscale levels included in the input image data based at least in part on a gamma curve.

In the above display device, the panel load calculator is further configured to sum the emission duty data and set the result as the load of the display panel.

In the above display device, the target driving voltage determiner is further configured to increase the target driving voltage based at least in part on an increased amount of a degree of degradation of the pixels.

In the above display device, the target driving voltage determiner is further configured to increase the target driving voltage so as to increase maximum luminance of the emitted light.

The display device of claim 1, wherein the target driving voltage determiner is further configured to decrease the target driving voltage so as to reduce power consumption of the pixels.

In the above display device, the target driving voltage determiner is further configured to determine the target driving voltage based at least in part on an image display mode.

In the above display device, the pixels include red, green and blue pixels respectively configured to emit red, green and blue light.

In the above display device, the pixels include red, green, blue and white pixels respectively configured emit red, green, blue and white light.

Another aspect is a method of driving a display device including a display panel, the method comprising generating emission duty data having an emission duty period based at least in part on input image data, calculating a load of the display panel based at least in part on the emission duty data, selectively determining a target driving voltage based at least in part on a color of light emitted from the pixels, adjusting the emission duty period of the emission duty data based at least in part on the calculated load and a magnitude of the target driving voltage, determining a target global current based at least in part on the calculated load, wherein the target global current corresponds to a total target amount of current to be supplied to the display panel, driving the display panel based at least in part on the adjusted emission duty data, supplying the driving voltage to the display panel, measuring a plurality of driving currents flowing into the display panel, and adjusting the driving voltage to have the target driving voltage based at least in part on the difference between the sum of the measured driving currents and the target global current.

In the above method, adjusting the emission duty period includes generating a first scale factor configured to be applied to the calculated load based at least in part on the calculated load, adjusting the first scale factor based at least in part on the magnitude of the target driving voltage so as to generate a second scale factor, and applying the second scale factor to the emission duty data so as to adjust the emission duty period.

In the above method, determining the target global current includes applying the first scale factor to the calculated load.

In the above method, the calculated load corresponds to a point on a predetermined net power control (NPC) curve.

According to at least one of the disclosed embodiments, the display device and the method of driving the display device increase the driving voltage to have certain calculated level so that the display device supplies the compensated data signals, which have the length of the emission duty shorter than a maximum length of an emission period in one frame, to the pixels. As a result, the maximum luminance of light emitted from the pixels can be increased as the driving voltage increases, and the power consumption can be reduced as the driving voltage decreases.

DETAILED DESCRIPTION OF CERTAIN INVENTIVE EMBODIMENTS

A pixel included degrades (e.g., burned in) as its driving time increases, and the luminance of emitted light will decrease as the pixel degrades. However, this degradation can be masked by employing a compensated data signal that is adjusted according to the degree of the degradation. For example, the display device can increase the length of the emission period (or the emission duty) to compensate for pixel degradation. However, although the display device supplies an adjusted data signal to compensate for the pixel degradation, the length of the emission period in one frame is limited.

Hereinafter, embodiments will be explained in detail with reference to the accompanying drawings. In this disclosure, the term "substantially" includes the meanings of completely, almost completely or to any significant degree under some applications and in accordance with those skilled in the art. Moreover, "formed on" can also mean "formed over." The term "connected" can include an electrical connection.

Figure 1:
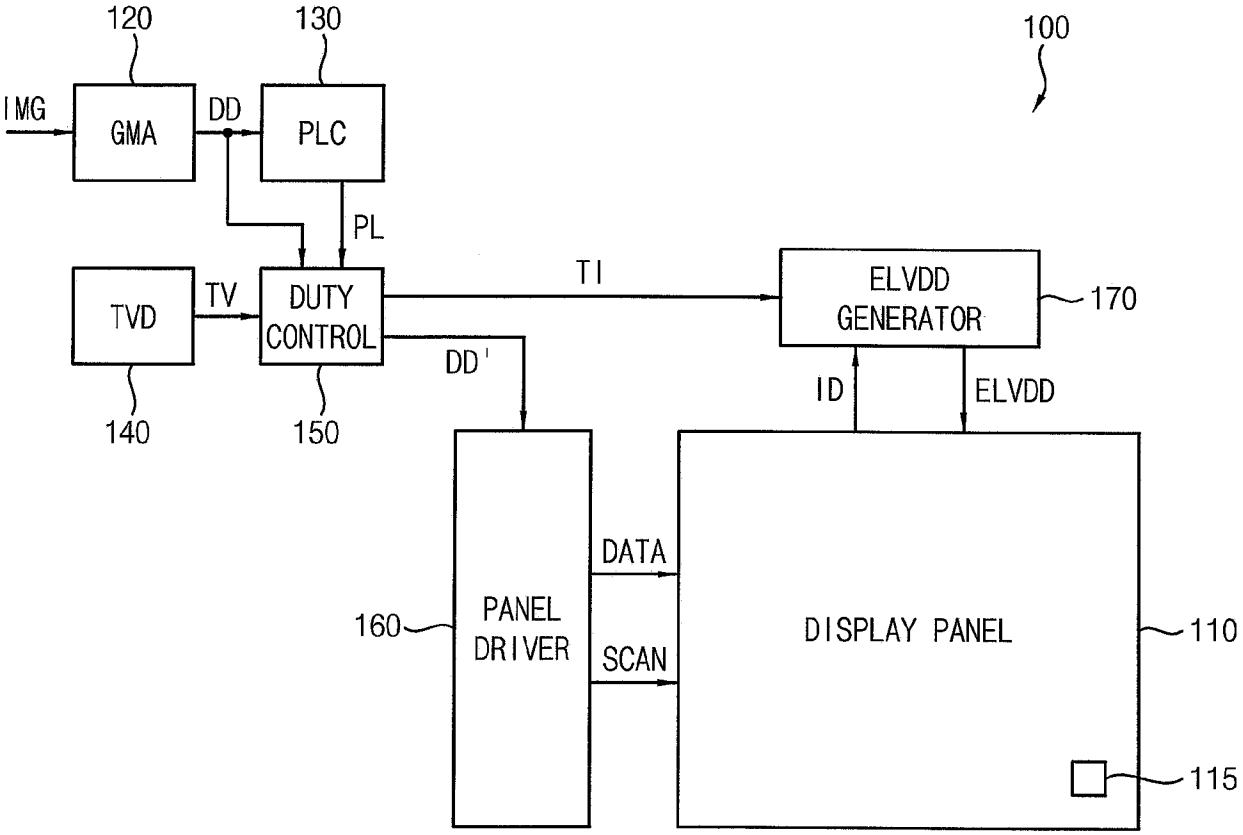
FIG. 1 is a block diagram illustrating a display device according to example embodiments.

FIG. 1 is a block diagram illustrating a display device according to example embodiments.

Referring to FIG. 1, the display device 100 includes a display panel 110, a gamma generator 120, a panel load calculator 130, a target driving voltage determiner 140, an emission duty controller 150, a display panel driver 160 and a driving voltage generator 170.

The display panel 110 includes a plurality of pixels 115. The pixels 115 can receive data signals DATA when scan signals SCAN are activated. The pixels can emit light based on a voltage level of the data signals and a driving voltage ELVDD.

In example embodiments, the pixels 115 includes first to (n)th pixels, where n is a positive integer. Emission duty data DD can include first to (n)th emission duty data. Driving currents ID can include first to (n)th driving currents.

A (k)th pixel can include a (k)th driving current generator and a (k)th OLED, where k is a positive integer less than or equal to n. The (k)th driving current generator can generate a (k)th driving current based on the driving voltage during a (k)th emission duty, or (k)th emission period, that is an emission period of the (k)th pixel in one frame. Here, a (k)th emission duty data have information of the (k)th emission duty. The (k)th OLED can emit light based on the (k)th driving current. Example embodiments of elements of the (k)th pixel will be described in detail with reference to FIG. 2.

In example embodiments, luminance of light emitted from the (k)th pixel is substantially proportional to a product of the (k)th emission duty and the (k)th driving current. The display device 100 including the (k)th pixel can be driven by a digital driving technique. The luminance of light emitted from the (k)th pixel can increase as the (k)th emission duty increases. Also, the luminance of light emitted from the (k)th pixel can increase as an amount of the (k)th driving current increases. That is, the luminance of light emitted from the (k)th pixel can be substantially proportional to the (k)th emission duty and the amount of the (k)th driving current. Example embodiments of the luminance of light of the (k)th pixel will be described in detail with reference FIG. 3.

In some embodiments, the pixels 115 include red pixels emitting red light, green pixels emitting green light and blue pixels emitting blue light. In some embodiments, the pixels 115 include the red pixels, the green pixels, the blue pixels and white pixels emitting white light.

The gamma generator 120 can generate the emission duty data DD having emission duty information based on input image data IMG. In example embodiments, the gamma generator 120 generates the emission duty data DD corresponding to a specific grayscale levels included in the input image data IMG based on a gamma curve.

A gamma setting for the display device 100 is defined as a correlation between grayscale levels and luminance of emitted light based on characteristics of the user's vision. A general gamma setting can be defined as a nonlinear correlation having a gamma value of about 2.2. In the digital driving manner, the luminance of emitted light can be substantially proportional to the emission duty that is an emission period of the pixel in one frame and the emission duty can be determined based on the emission duty data DD. The correlation between the grayscale levels and the emission duty data satisfying the gamma setting can be defined by the gamma curve. Thus, the gamma generator 120 can generate the emission duty data DD corresponding to the grayscale levels included in the input image data IMG based on the gamma curve that corresponds to the gamma setting. Example embodiments of the emission duty data DD generated by the gamma generator will be described in detail with reference to FIG. 5.

The panel load calculator 130 can calculate a load of the display panel PL based on the emission duty data DD. The driving currents ID can increase as the luminance of light emitted from the pixels 115 increases. As a result, the sum of the driving currents ID flowing into the display panel 110 can increase. Power consumption for driving the display panel 110 can increase as the sum of the driving currents ID increases. Therefore, the panel load calculator 130 can calculate the load of the display panel PL to estimate the sum of the driving currents ID. In some embodiments, the panel load calculator 130 calculates the load of the display panel PL by calculating the sum of the emission duty data DD.

The target driving voltage determiner 140 can determine a target driving voltage TV. The target driving voltage determiner 140 can selectively determine the target driving voltage TV according to a color of light emitted from the pixels 115 to adjust the driving voltage ELVDD to be the target driving voltage TV. For example, the target driving voltage determiner 140 increases the target driving voltage TV of the blue pixels and does not adjust the target driving voltage TV of the red and green pixels.

In example embodiments, the target driving voltage determiner 140 increases the target driving voltage TV as a degree of degradation of the pixels increases. The degradation can be compensated by increasing the emission duty of the pixels 115 when the degradation of the pixels 115 increases. However, the maximum length of the emission period can be limited within the one frame. Therefore, the driving voltage ELVDD applied to the pixels 115 can be increased to compensate the degradation of the pixels 115.

In example embodiments, the target driving voltage determiner 140 increases the target driving voltage TV to increase a maximum luminance of light emitted from the pixels 115. In the digital driving manner, the luminance of light emitted from the pixels 115 can be substantially proportional to a product of the driving voltage ELVDD and the emission duty. Therefore, the target driving voltage determiner 140 can increase the maximum luminance of light emitted from the pixels 115 by increasing the target driving voltage TV.

In example embodiments, the target driving voltage determiner 140 decreases the target driving voltage TV to reduce power consumption of the pixels 115. In the digital driving manner, the power consumption of the pixels 115 can increase as the driving voltage increases, and the power consumption of the pixels 115 can decrease as the driving voltage decreases. Therefore, the target driving voltage determiner 140 can reduce the power consumption of the pixels 115 by decreasing the target driving voltage TV.

In example embodiments, the target driving voltage determiner 140 determines the target driving voltage TV based on an image display mode. A specific color can be highlighted based on the image display mode. For example, a user selects a red (e.g., infrared) phototherapy mode. In the red phototherapy mode, the display panel 110 can highlight luminance of light emitted from the red pixels. Therefore, the target driving voltage determiner 140 can increase the luminance of light from the pixels 115 by increasing the target driving voltage TV of the red pixels.

The emission duty controller 150 can adjust the emission duty of the emission duty data DD based on the calculated load PL and a magnitude of the target driving voltage TV. Also, the emission duty controller 150 can determine a target global current TI based on the calculated load PL. The target global current TI can be the sum of currents to be flowed into the display panel. In example embodiments, the emission duty controller 150 includes a power consumption controller and a global current determiner.

The power consumption controller can generate a first scale factor based on the calculated load PL. The first scale factor can be applied to the calculated load to determine the target global current. The power consumption controller can generate a second scale factor that is an adjusted value of the first scale factor based on the magnitude of the target driving voltage TV. The power consumption controller can adjust the emission duty by applying the second scale factor to the emission duty data DD. That is, the power consumption controller can generate the adjusted emission duty data DD'. Example embodiments of an operation of the power consumption controller will be described in detail with reference to FIG. 6.

In example embodiments, the power consumption controller generates the first scale factor corresponding to the calculated load PL referring to a predetermined Net Power Control (NPC) curve. The power consumption controller can include the NPC curve that defines a relationship between the calculated load PL and the first scale factor. Therefore, the power consumption controller can generate the first scale factor corresponding to the calculated load PL. Example embodiments of the operation of the power consumption controller based on the NPC curve will be described in detail with reference to FIG. 4.

In example embodiments, the power consumption controller generates the decreased first scale factor according to an increase of the calculated load PL when the calculated load PL is greater than a predetermined critical load. The luminance of light emitted from the pixels 115 can be relatively low when the calculated load PL is less than the critical load. In some embodiments, the first scale factor does not change to emphasize emitted color of light of the pixel 115 that emits relatively high luminance, when the calculated load changes. In contrast, the luminance of light emitted from the pixels 115 can be relatively high when the calculated load PL is greater than the critical load. In this case, the first scale factor can be decreased to reduce the power consumption of the pixels 115.

The global current determiner can determine the target global current TI based on the calculated load PL and the first scale factor.

In example embodiments, the global current determiner applies the first scale factor to the calculated load PL to determine the target global current TI. The adjusted emission duty data DD' can be generated by applying the second scale factor. In contrast, the target global current TI can be generated by applying the first scale factor. The target global current TI does not change compared to the adjusted emission duty data DD' when the target driving voltage TV changes.

The display panel driver 160 can drive the display panel 110 based on the adjusted emission duty data DD'. In example embodiments, the display panel driver 160 includes a data driver configured to generate data signals DATA and a scan driver configured to generate scan signals SCAN.

The display panel driver 160 can generate the data signals DATA based on the adjusted emission duty data DD'. In the digital driving manner, the data signals DATA can have an activation voltage corresponding to '1' and a deactivation voltage corresponding to '0'.

The display panel driver 160 can generate the scan signals SCAN to supply the data signals DATA to target pixel among the pixels 115. As a result, the pixels 115 can receive the data signals DATA during scan signals SCAN being activated.

The driving voltage generator 170 can apply the driving voltage ELVDD to the display panel 110. The driving voltage generator 170 can measure the driving currents ID flowing into the display panel 110. The driving voltage generator 170 can adjust the driving voltage ELVDD based on the difference between the sum of the measured driving currents ID and the target global current TI. That is, the driving voltage generator 170 can adjust the driving voltage ELVDD so that the driving voltage ELVDD can reach the target driving voltage TV. For example, the driving voltage generator 170 increases a voltage level of the driving voltage ELVDD when the sum of the measured driving currents ID is less than the target global current TI. However, the driving voltage generator 170 can decrease the voltage level of the driving voltage ELVDD when the sum of the measured driving currents ID is greater than the target global current TI.

In some embodiments, the emission duty controller 150 can change the adjusted emission duty data DD' but not change the target global current TI when the target driving voltage TV changes. Therefore, the emission duty of the pixels 115 can change and the measured driving currents ID can change. However, the target voltage generator 170 can adjust the driving voltage ELVDD because the target global current TI does not change. For example, the emission duty controller 150 decreases the emission duty by controlling the adjusted emission duty data DD' when the target driving voltage TV is increased. As a result, the target voltage generator 170 can increase the driving voltage ELVDD up to the target driving voltage TV because the measured driving currents ID are decreased but the target global current TI do not change.

As described above, the driving voltage generator 170 can increase the driving voltage ELVDD to have certain calculated level so that the adjusted emission duty data DD', which has the length of the emission duty shorter than the maximum length of an emission period in one frame, can be supplied to the pixels 115. As a result, the maximum luminance of light emitted from the pixels 115 can be increased as the driving voltage ELVDD increases, and power consumption can be reduced as the driving voltage ELVDD decreases.

Figure 2:
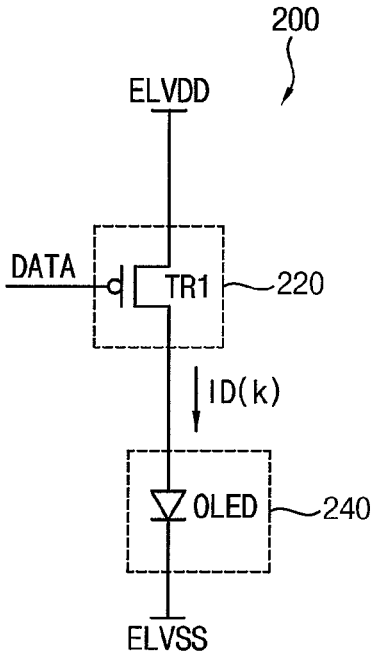
FIG. 2 is a circuit diagram illustrating an example of a (k)th pixel included in the display device of FIG. 1.

FIG. 2 is a circuit diagram illustrating an example of a (k)th pixel included in the display device of FIG. 1.

Referring to FIG. 2, the (k)th pixel 200 includes a (k)th driving current generator 220 and a (k)th OLED 240.

The (k)th driving current generator 220 can generate a (k)th driving current ID(k) based on a driving voltage ELVDD during a (k)th emission duty. The (k)th emission duty can be an emission period of the (k)th pixel in one frame. Here, the (k)th emission duty can correspond to a (k)th emission duty data.

The (k)th driving current generator 220 can include a driving transistor TR1. The driving transistor can include a gate terminal, a first terminal and a second terminal. Here, the gate terminal can receive a data signal DATA. The first terminal can receive the driving voltage ELVDD. The second terminal can be connected to the (k)th OLED 240.

The (k)th OLED 240 can emit light based on the (k)th driving current ID(k). The OLED includes a first terminal and a second terminal. Here, the first terminal can be connected to the (k)th driving current generator 220. The second terminal can receive a reference voltage ELVSS.

The transistor TR1 can supply the driving voltage ELVDD to the first terminal of the OLED based on a voltage level of the data signal. The driving current ID(k) that is generated based on a voltage difference between the driving voltage ELVDD supplied to the first terminal and the reference voltage ELVSS supplied to the second terminal can flow through the OLED. The OLED can emit light based on the driving current ID(k).

Figure 3:
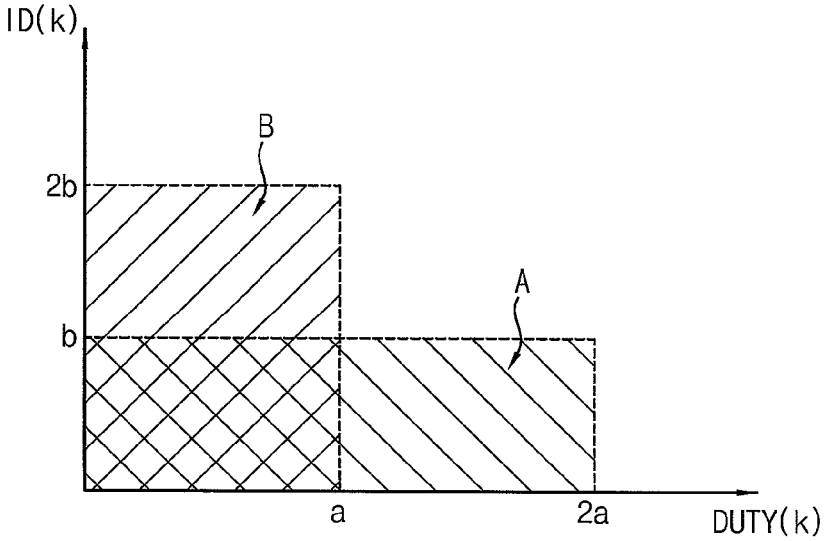
FIG. 3 is a diagram illustrating an example of a luminance of light emitted from the (k)th pixel included in the display device of FIG. 1.

FIG. 3 is a diagram illustrating an example of a luminance of light emitted from the (k)th pixel included in the display device of FIG. 1.

Referring to FIG. 3, the luminance of light emitted from the (k)th pixel is substantially proportional to the product of a (k)th emission duty DUTY(k) and a (k)th driving current ID(k).

The luminance of light emitted from the (k)th pixel can increase as the (k)th emission duty DUTY(k) increases. Also, the luminance can increase as an amount of the (k)th driving current ID(k) increases. That is, the luminance can be substantially proportional to the (k)th emission duty DUTY(k) and the amount of the (k)th driving current ID(k). As a result, the luminance can be substantially proportional to an area of a rectangle having one side (e.g., a horizontal line) that corresponds to the (k)th emission duty DUTY(k) and another side (e.g., a vertical line) that corresponds to the (k)th driving current ID(k).

For example, the (k)th emission duty DUTY(k) has a value of 2a and the (k)th driving current ID(k) has a value of b. Here, the luminance of light emitted from the (k)th pixel can be substantially proportional to an area A of a rectangle having one side equal to 2a and the other side equal to b. That is, the luminance can be substantially proportional to a value of 2ab (i.e., $2a \times b$).

As another example, the (k)th emission duty DUTY(k) has a value of a and the (k)th driving current ID(k) has a value of 2b. Here, the luminance of light emitted from the (k)th pixel can be substantially proportional to an area B of the rectangle having one side equal to a and the other side equal to 2b. That is, the luminance of light emitted from the (k)th pixel can be substantially proportional to a value of 2ab (i.e., $a \times 2b$). The luminance can be substantially the same because the areas A and B of the rectangles are substantially same.

As described above, the (k)th pixel can emit light of the same luminance by controlling the (k)th driving current ID(k) in spite of the differences in the (k)th emission duty DUTY(k). Therefore, a driving voltage generator 170 included in the display device 100 of FIG. 1 can adjust the sum of driving currents to be a target global current by controlling the driving currents when adjusted emission duty data is changed. The driving voltage generator 170 can adjust the driving voltage to control the driving currents because the driving currents increase as the driving voltage increases.

Figure 4:
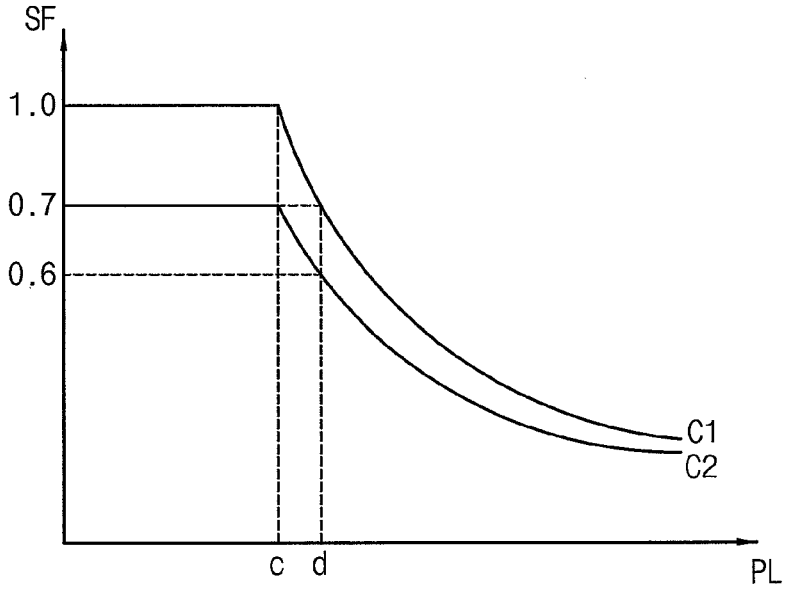
FIG. 4 is a diagram illustrating an example of first scale factors generated by a power consumption controller included in the display device of FIG. 1.

FIG. 4 is a diagram illustrating an example of first scale factors generated by a power consumption controller included in the display device of FIG. 1.

Referring to FIG. 4, the power consumption controller included in an emission duty controller generates the first scale factor SF corresponding to a calculated load PL referring to a predetermined first Net Power Control (NPC) curve C1 and a predetermined second NPC curve C2. The power consumption controller can include the NPC curves C1 and C2 that define a relationship between the calculated load PL and the first scale factor SF. Therefore, the power consumption controller can generate the first scale factor SF corresponding to the calculated load PL by referencing the NPC curves C1 and C2. The NPC curves C1 and C2 can differ based at least in part on each color displayed by pixels. For example, the first NPC curve C1 is applied for a red pixel and a green pixel. The second NPC curve C2 can be applied for a blue pixel. The power consumption controller can generate the first scale factor SF having a value of about 1.0 corresponding to the red and green pixels when the calculated load PL has a value of c. The power consumption controller can generate the first scale factor SF having a value of about 0.7 corresponding to the blue pixel when the calculated load PL has the value of c. Also, the power consumption controller can generate the first scale factor SF having a value of about 0.7 corresponding to the red and green pixels when the calculated load PL has a value of d. The power consumption controller can generate the first scale factor SF having a value of about 0.6 corresponding to the blue pixel when the calculated load PL has the value of d.

Figure 5:
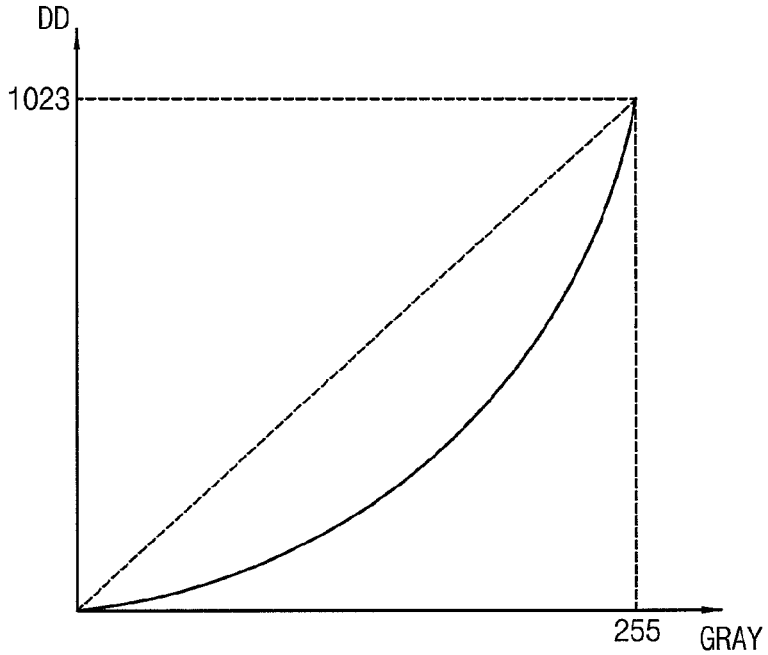
FIG. 5 is a diagram illustrating an example of an emission duty data generated by a gamma generator included in the display device of FIG. 1.
Figure 6:
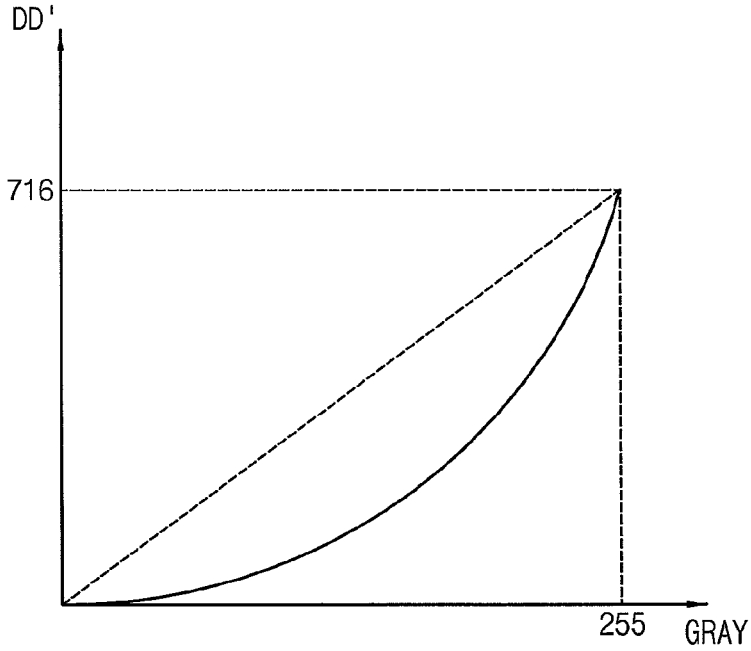
FIG. 6 is a diagram illustrating an example of an emission duty data controlled by an emission duty controller included in the display device of FIG. 1.

FIG. 5 is a diagram illustrating an example of an emission duty data generated by a gamma generator included in the display device of FIG. 1. FIG. 6 is a diagram illustrating an example of an emission duty data controlled by an emission duty controller included in the display device of FIG. 1.

Referring to FIG. 5, the gamma generator generates the emission duty data corresponding to grayscale levels GRAY included in input image data. In the display device driven by a digital driving technique, a luminance of emitted light can be substantially proportional to an emission duty, and the emission duty can be controlled based on the emission duty data DD. Therefore, a correlation between grayscale levels GRAY and the emission duty data satisfying a gamma setting can be defined by a gamma curve. Thus, the gamma generator can generate the emission duty data DD corresponding to the grayscale levels GRAY included in the input image data based on the gamma curve that corresponds to the gamma setting. For example, the gamma generator generates the emission duty data having a value of about 1023 corresponding to the grayscale level of about 255.

Referring to FIG. 6, the emission duty controller adjusts the emission duty data. In some embodiments, a power consumption controller included in the emission duty controller generates the adjusted emission duty data DD'.

The power consumption controller can generate a first scale factor based on the calculated load. The power consumption controller can generate a second scale factor that is an adjusted value of the first scale factor based on the magnitude of the target driving voltage. The power consumption controller can adjust the emission duty by applying the second scale factor to the emission duty data. That is, the power consumption controller can generate the adjusted emission duty data DD'. For example, the second scale factor can be about 0.7. Therefore, the power consumption controller can generate the adjusted emission duty data having a value of about 716 corresponding to the grayscale level of about 255 by applying about 0.7 to the emission duty data.

Figure 7:
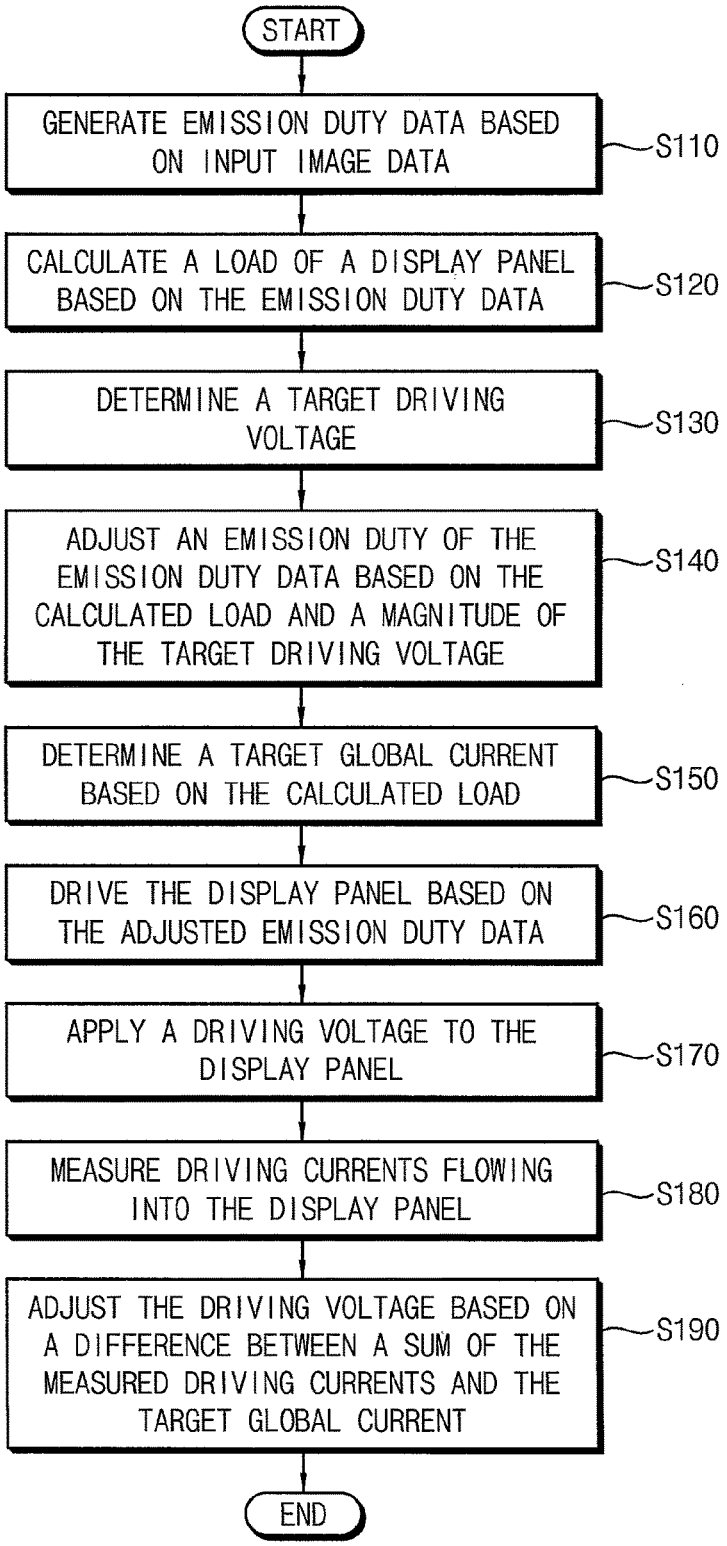
FIG. 7 is a flowchart illustrating a method of driving the display device according to example embodiments.

FIG. 7 is a flowchart illustrating a method of driving the display device according to example embodiments.

Referring to FIG. 7, a method includes generating emission duty data S110, calculating a load of the display panel S120, selectively determining a target driving voltage S130, and adjusting an emission duty of the emission duty data S140. Also, the method can include determining a target global current S150, driving the display panel S160, and applying a driving voltage S170. Further, the method can include measuring driving currents S180 and adjust the driving voltage S190.

In some embodiments, the FIG. 7 procedure is implemented in a conventional programming language, such as C or C++ or another suitable programming language. The program can be stored on a computer accessible storage medium of the display device 100, for example, a memory (not shown) of the display device 100 or the panel driver 160. In certain embodiments, the storage medium includes a random access memory (RAM), hard disks, floppy disks, digital video devices, compact discs, video discs, and/or other optical storage mediums, etc. The program can be stored in the processor. The processor can have a configuration based on, for example, i) an advanced RISC machine (ARM) microcontroller and ii) Intel Corporation's microprocessors (e.g., the Pentium family microprocessors). In certain embodiments, the processor is implemented with a variety of computer platforms using a single chip or multichip microprocessors, digital signal processors, embedded microprocessors, microcontrollers, etc. In another embodiment, the processor is implemented with a wide range of operating systems such as Unix, Linux, Microsoft DOS, Microsoft Windows 8/7/Vista/2000/9x/ME/XP, Macintosh OS, OS X, OS/2, Android, iOS and the like. In another embodiment, at least part of the procedure can be implemented with embedded software. Depending on the embodiment, additional states can be added, others removed, or the order of the states changed in FIG. 7.

The method of FIG. 7 includes generating the emission duty data having emission duty information based on input image data S110. In some embodiments, the emission duty data corresponding to a specific grayscale levels included in the input image data is generated based on a gamma curve S110.

A gamma setting for the display device is defined as a correlation between grayscale levels and luminance of emitted light based on characteristics of the human eyes or user visibility. A general gamma setting can be defined as a nonlinear correlation having a gamma value of about 2.2. In the display device driven by a digital driving technique, the luminance of emitted light can be substantially proportional to the emission duty that is an emission period of the pixel in one frame and the emission duty can be determined based on the emission duty data. The correlation between the grayscale levels and the emission duty data satisfying the gamma setting can be defined by the gamma curve. Thus, the emission duty data corresponding to the grayscale levels included in the input image data can be generated based on the gamma curve that complies with the gamma setting.

The method of FIG. 7 includes calculating the load of the display panel based on the emission duty data S120. Driving currents can increase as a luminance of light emitted from the pixels increases. As a result, the sum of the driving currents flowing into the display panel can increase. Power consumption for driving the display panel can increase as the sum of the driving currents increases. Therefore, the load of the display panel can be calculated to estimate the sum of the driving currents. In example embodiments, the load of the display panel is calculated by calculating the sum of the emission duty data.

The method of FIG. 7 includes determining a target driving voltage S130. The target driving voltage can be selectively determined according to a color of light emitted from the pixels to adjust a driving voltage to be the target driving voltage.

The method of FIG. 7 includes adjusting the emission duty of the emission duty data based on the calculated load and a magnitude of the target driving voltage S140.

In example embodiments, a first scale factor and a second scale factor are generated and the emission duty of the emission duty data is adjusted. The first scale factor can be generated based on the calculated load. Also, the second scale factor, that is an adjusted value of the first scale factor based on the magnitude of the target driving voltage, can be generated. Further, the emission duty data can be adjusted by applying the second scale factor to the emission duty data. That is, a power consumption controller can generate the adjusted emission duty data.

In some embodiments, the first scale factor corresponds to the calculated load referring to a predetermined Net Power Control (NPC) curve. That is, the first scale factor corresponding to the calculated load can be generated by referencing the NPC curve.

In some embodiments, the first scale factor is decreased according to an increase of the calculated load when the calculated load is greater than a predetermined critical load. The luminance of light emitted from the pixels can be relatively low when the calculated load is less than the critical load. In this case, the first scale factor does not change to emphasize emitted color of light of the pixel that emits relatively high luminance, when the calculated load changes. In contrast, the luminance of light emitted from the pixels can be relatively high when the calculated load is greater than the critical load. In this case, the first scale factor can be decreased to reduce the power consumption of the pixels.

The method of FIG. 7 includes determining a target global current based on the calculated load S150. For example, the target global current is determined based on the calculated load and the first scale factor.

In some embodiments, the target global current is determined by applying the first scale factor to the calculated load S150. The adjusted emission duty data can be generated by applying the second scale factor. In contrast, the target global current can be generated by applying the first scale factor. In some embodiments, the target global current does not change in contrast with the adjusted emission duty data when the target driving voltage changes.

The method of FIG. 7 includes driving the display panel based on the adjusted emission duty data S160.

The data signals can be generated based on the adjusted emission duty data. In the digital driving manner, the data signals can have an activation voltage corresponding to '1' and a deactivation voltage corresponding to '0'.

The scan signals can be generated to supply the data signals to target pixel among the pixels. As a result, the pixels can receive data signals during scan signals being activated.

The method of FIG. 7 includes applying the driving voltage to the display panel S170 and measuring driving currents flowing into the display panel S180. Also, the method can include adjusting the driving voltage based on the difference between the sum of the measured driving currents and the target global current S190. That is, a driving voltage generator can adjust the driving voltage so that the driving voltage can reach the target driving voltage. For example, a voltage level of the driving voltage is increased when the sum of the measured driving currents is less than the target global current. However, the voltage level of the driving voltage can be decreased when the sum of the measured driving currents is greater than the target global current.

In some embodiments, the adjusted emission duty data can be changed but the target global current is not changed when the target driving voltage changes. Therefore, the emission duty of the pixels can change and the measured driving currents can change. However, the driving voltage can be adjusted because the target global current does not change. For example, the emission duty is decreased by controlling the adjusted emission duty data when the target driving voltage is increased. As a result, the driving voltage can be increased up to the target driving voltage because the measured driving currents are decreased but the target global current does not change.

As described above, the driving voltage generator can increase the driving voltage to have a certain calculated level so that the adjusted emission duty data, which has the length of the emission duty shorter than the maximum length of an emission period in one frame, can be supplied to the pixels. As a result, the maximum luminance of light emitted from the pixels can be increased as the driving voltage increases, and power consumption can be reduced as the driving voltage decreases. Although it is described above that the maximum grayscale level is 255, a range of the grayscale level is not limited.

The described technology can be applied to any electronic device including a display device. For example, the described technology is applied to desktop and laptop computers, digital cameras, video camcorders, cellular phones, smartphones, smart pads, PMPs, PDAs, MP3 players, navigation systems, video phones, monitoring systems, tracking systems, motion detecting systems, image stabilization systems, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the inventive technology. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A display device, comprising:

a display panel including a plurality of pixels configured to emit light, wherein the display panel is configured to be digitally driven based at least in part on a driving voltage;

a gamma generator configured to generate emission duty data having an emission duty period based at least in part on input image data;

a panel load calculator configured to calculate a load of the display panel based at least in part on the emission duty data;

a target driving voltage determiner configured to selectively determine a target driving voltage based at least in part on a color of the emitted light;

an emission duty controller configured to i) adjust the emission duty period based at least in part on the calculated load and the magnitude of the target driving voltage and ii) determine a target global current based at least in part on the calculated load, wherein the target global current corresponds to a total target amount of current to be supplied to the display panel;

a display panel driver configured to drive the display panel based at least in part on the adjusted emission duty period; and a driving voltage generator configured to i) supply the driving voltage to the display panel, ii) measure driving currents flowing into the display panel, and iii) adjust the driving voltage to include the target driving voltage based at least in part on the difference between the sum of the measured driving currents and the target global current.

2. The display device of claim 1, wherein the emission duty controller includes:

a power consumption controller configured to i) generate a first scale factor configured to be applied to the calculated load based at least in part on the calculated load, ii) adjust the first scale factor based at least in part on the magnitude of the target driving voltage so as to generate a second scale factor, and iii) apply the second scale factor to the emission duty data so as to adjust the emission duty period; and a global current determiner configured to determine the target global current based at least in part on the calculated load and the first scale factor.

3. The display device of claim 2, wherein the power consumption controller is further configured to decrease the second scale factor when the target driving voltage increases and increase the second scale factor when the target driving voltage decreases.

4. The display device of claim 3, wherein the calculated load corresponds to a point on a predetermined net power control (NPC) curve.

5. The display device of claim 3, wherein the power consumption controller is further configured to decrease the first scale factor based at least in part on an increased amount of the calculated load when the calculated load is greater than a predetermined critical load.

6. The display device of claim 3, wherein the global current determiner is further configured to apply the first scale factor to the calculated load so as to determine the target global current.

7. The display device of claim 1, wherein the pixels include first to (n)th pixels, wherein the emission duty data includes first to (n)th emission duty data, wherein the driving currents include first to (n)th driving currents, where n is a positive integer, and wherein a (k)th pixel includes, where k is a positive integer less than or equal to n:

a (k)th driving current generator configured to generate a (k)th driving current based at least in part on the driving voltage during a (k)th emission period of the (k)th pixel in one frame; and a (k)th light-emitting diode (LED) configured to emit light based at least in part on the (k)th driving current.

8. The display device of claim 7, wherein the luminance of the light emitted from the (k)th pixel is substantially proportional to the product of the (k)th emission duty period and the k-th driving current.

9. The display device of claim 1, wherein the gamma generator is further configured to generate the emission duty data corresponding to grayscale levels included in the input image data based at least in part on a gamma curve.

10. The display device of claim 1, wherein the panel load calculator is further configured to sum the emission duty data and set the result as the load of the display panel.

11. The display device of claim 1, wherein the target driving voltage determiner is further configured to increase the target driving voltage based at least in part on an increased amount of a degree of degradation of the pixels.

12. The display device of claim 1, wherein the target driving voltage determiner is further configured to increase the target driving voltage so as to increase maximum luminance of the emitted light.

13. The display device of claim 1, wherein the target driving voltage determiner is further configured to decrease the target driving voltage so as to reduce power consumption of the pixels.

14. The display device of claim 1, wherein the target driving voltage determiner is further configured to determine the target driving voltage based at least in part on an image display mode.

15. The display device of claim 1, wherein the pixels include red, green and blue pixels respectively configured to emit red, green and blue light.

16. The display device of claim 1, wherein the pixels include red, green, blue and white pixels respectively configured emit red, green, blue and white light.

17. A method of driving a display device including a display panel, the method comprising:

generating emission duty data having an emission duty period based at least in part on input image data;

calculating a load of the display panel based at least in part on the emission duty data;

selectively determining a target driving voltage based at least in part on a color of light emitted from the pixels;

adjusting the emission duty period of the emission duty data based at least in part on the calculated load and a magnitude of the target driving voltage;

determining a target global current based at least in part on the calculated load, wherein the target global current corresponds to a total target amount of current to be supplied to the display panel;

driving the display panel based at least in part on the adjusted emission duty data;

supplying the driving voltage to the display panel;

measuring a plurality of driving currents flowing into the display panel; and adjusting the driving voltage to have the target driving voltage based at least in part on the difference between the sum of the measured driving currents and the target global current.

18. The method of claim 17, wherein adjusting the emission duty period includes:

generating a first scale factor configured to be applied to the calculated load based at least in part on the calculated load;

adjusting the first scale factor based at least in part on the magnitude of the target driving voltage so as to generate a second scale factor; and applying the second scale factor to the emission duty data so as to adjust the emission duty period.

19. The method of claim 18, wherein determining the target global current includes applying the first scale factor to the calculated load.

20. The method of claim 18, wherein the calculated load corresponds to a point on a predetermined net power control (NPC) curve.

* * * * *